US005923301A

United States Patent [19]

Chen

[11] Patent Number: 5,923,301

[45] Date of Patent: Jul. 13, 1999

[54] ANTENNA SYSTEM HAVING DIRECTIVITY FOR ELONGATE SERVICE ZONE

[75] Inventor: Shuguang Chen, Tokyo, Japan

[73] Assignee: NEC Corporation, Tokyo, Japan

[21] Appl. No.: 09/004,067

[22] Filed: Jan. 8, 1998

[30] Foreign Application Priority Data

Jan. 8, 1997 [JP] Japan ..... 9-001003

[51] Int. Cl.[6] ..... H01Q 9/16; H01Q 19/10

[52] U.S. Cl. ..... 343/795; 343/818; 343/846

[58] Field of Search ..... 343/795, 829, 343/825, 845, 846, 848, 818, 700 MS, 900, 895; H01Q 9/16, 19/10

[56] References Cited

U.S. PATENT DOCUMENTS

| | | | |
|---|---|---|---|
| 4,114,163 | 9/1978 | Borowick | 343/815 |
| 5,220,334 | 6/1993 | Raguenet et al. | 343/700 MS |
| 5,434,580 | 7/1995 | Raguenet et al. | 343/700 MS |

FOREIGN PATENT DOCUMENTS

| | | |
|---|---|---|
| 59-114906 | 7/1984 | Japan . |
| 61-214805 | 9/1986 | Japan . |
| 8-051314 | 2/1996 | Japan . |

*Primary Examiner*—Hoanganh Le
*Attorney, Agent, or Firm*—Young & Thompson

[57] ABSTRACT

An antenna system is adapted to be installed on a ceiling surface or on one of side wall surfaces of a space defined by the ceiling surface, the side wall surfaces and a floor surface. The antenna includes a reflector and a radiator element. The reflector has a grounded plate, a dielectric layer formed on the grounded plate, and metal strips having patterns parallel to the longitudinal direction of the space and formed on the dielectric layer. The radiator element is disposed to be perpendicular to a reflecting surface of the reflector. The radiator element may be in a bar form, a cylindrical form or at least partly a coil form. The distance between the center of the longitudinal direction of the radiator element and the reflector is set to be about 0.1 to 0.6 times the wavelength of the working frequency. The antenna system has high directivity along an elongate space such as a tunnel, a corridor or an underground shopping area.

8 Claims, 9 Drawing Sheets

ANTENNA SYSTEM HAVING DIRECTIVITY FOR ELONGATE SERVICE ZONE

BACKGROUND OF THE INVENTION (1) Field of the Invention

The present invention relates to antennas, and more particularly to antennas which can be used in broadcast and mobile communication radio stations and also in such locality as elongate underground shopping areas and tunnels.

(2) Description of the Related Art

Antennas of the kind to which the present invention relates have recently been finding applications familiar to our life, such as radio broadcast, television broadcast and mobile communication systems such as pocket bells, portable telephones and car telephones.

Radio base station facilities to be installed in tunnels, passageways, rooms, underground shopping areas, etc., are provided in such a way that they are not obstructive to traffics of passers-by. Specifically, main bodies are installed inside ceiling surface boards, while antennas are mounted thereon such that they penetrate the ceiling surface boards toward passages.

Antennas used are non-directivity antennas of rod or bar-like or planar type. Bar-like antennas are frequently used as base station antennas, because they are elongate in form and less noticeable from a scenic stand point.

FIGS. 1A and 1B show, in a perspective view and a side view respectively, a prior art antenna. Referring to these Figures, reference numeral 11 designates an antenna element, 12 a metal conducting plate, and 13 an antenna element supporting member. This antenna is shown in Japanese Patent Application Kokai Publication No. Hei 8-51314.

Many mobile stations have small output power, because they are required from their characters to be small in size and light in weight and consume low power. On the base station side, on the other hand, the transmission output power is set to be relatively high because of the necessity for the base station to cover pertinent large areas for such purposes as calling mobile stations.

Also, in order to maintain a good communication condition with many mobile stations, antennas are installed at high levels such as building roofs. Their working frequency ranges from several hundred MHz to several GHz. As for the radio frequency to be used, higher frequencies are more advantageous from the standpoint of the effective frequency utilization and the antenna size of the mobile station.

With the above prior art antenna, the necessary number of base station antennas is increased when it is intended to cover zones extending along elongate service areas such as roads. When the overall radiation power is increased, the electromagnetic wave energy radiated in the transversal direction of the road is wasted.

SUMMARY OF THE INVENTION

An object of the invention, therefore, is to overcome the problems existing in the prior art, and to provide a simplified antenna which has high directivity in the directions of roads and passages in elongate service zones such as tunnels and underground shopping zones, and permits realizing a satisfactory coverage by suppressing wave radiation in directions perpendicular to the roads and passages.

According to the present invention, there is provided an antenna system installed on a ceiling surface or on one of side wall surfaces of a space defined by the ceiling surface, the side wall surfaces and a floor surface, the antenna system comprising:

a reflector including a grounded plate, a dielectric layer formed on the grounded plate, and metal strips having patterns parallel to the longitudinal direction of the space and formed on the dielectric layer; and a radiator element disposed to be perpendicular to a reflecting surface of the reflector.

In the above antenna system, the radiator element may be one of a bar form, a cylindrical form, and at least partly a coil form.

The reflector is mounted with the grounded plate being positioned upwardly, and the radiator is mounted on the reflector such that it comes underside of the surface of the metal strips. The radiator element has between its center and the reflector a distance set to be about 0.1 to 0.6 times the wavelength of the working frequency.

The radiator element may be a linear antenna having a length set to be about 0.25 to 0.5 times the wavelength of the working frequency. The radiator element may be one of a mono-pole antenna and a dipole antenna with a feeding point thereof being spaced apart from the reflector by a distance equal to about 0 to 0.06 times the wavelength of the working frequency.

In the above antenna system, the reflector has the dielectric layer disposed between the metal strips and the grounded plate and formed in a uniform thickness. The metal strips have between adjacent ones thereof a pitch and an interval being set to be about 0.01 to 0.35 times the wavelength of the working frequency. The dielectric constant of the dielectric layer is set to be about 1 to 5.5. The thickness of the dielectric layer is set to be about 0.1 to 0.5 times the wavelength. The reflector has its area computed by various parameters that are set to be at least about 3.5 times the wavelength of the working frequency.

The phase of the reflection coefficient of the reflector is variable by appropriately selecting structural parameters thereof, i.e., the pitch and the interval between the metal strips and the dielectric constant and the thickness of the dielectric layer. The radiator element of the antenna is a linear vertically polarized antenna substantially parallel to a post structure.

When the construction as described above is viewed in X-Z plane of the antenna, the plane containing the electric field vector is parallel to the metal strips, and the incident electromagnetic field cannot be transmitted through but is reflected by the surface of the metal strips. The reflection coefficient is a constant of +1 as in the case of a metal conducting plate (grounded plate). The far electromagnetic field is intensified because the electromagnetic field radiated directly from the radiator element and the electromagnetic field reflected from the reflector are in phase. In other words, the radiated electromagnetic field has a maximum intensity in the direction parallel to the metal strips. The constant here is a fixed reflection coefficient determined by the working frequency and the pitch and the interval between adjacent ones of the metal strips.

When the above construction is viewed from Y-Z plane of the antenna, the plane containing the electric field vector is perpendicular to the metal strips, and the incident electromagnetic field is transmitted through the surface of the metal strips and the dielectric layer, and is reflected by the metal conducting plate. The reflection coefficient is a constant of +1 as in the case of the metal conducting plate. When it is considered that the metal strips constitute a reference reflection surface, the delayed phase of the reflection coefficient is EXP(−jk2W).

The phase of the reflection coefficient is thus variable from 0 to 180 degrees by adjusting the thickness of the dielectric layer. The electromagnetic field directly radiated from the radiator element is weakened or canceled out by the electromagnetic field reflected by the reflector. The radiated electromagnetic field has a minimum intensity in the direction perpendicular to the metal strips.

In the above construction, the radiator element is disposed on a boundary wall surface between planar metal strips such that its axis is perpendicular to the surface of the reflector. The distance between the surface of the metal strips and the center of the antenna, is set to be about 0.1 to 0.6 times the wavelength of the working frequency. The boundary wall between the metal strips is directed along, i.e., in the longitudinal direction of, the road. As the radiation directivity of the antenna, it is thus possible to obtain an elliptical characteristic suited for elongate service areas such as an underground shopping-area or a tunnel.

PREFERRED EMBODIMENTS OF THE INVENTION

Figure 1A:
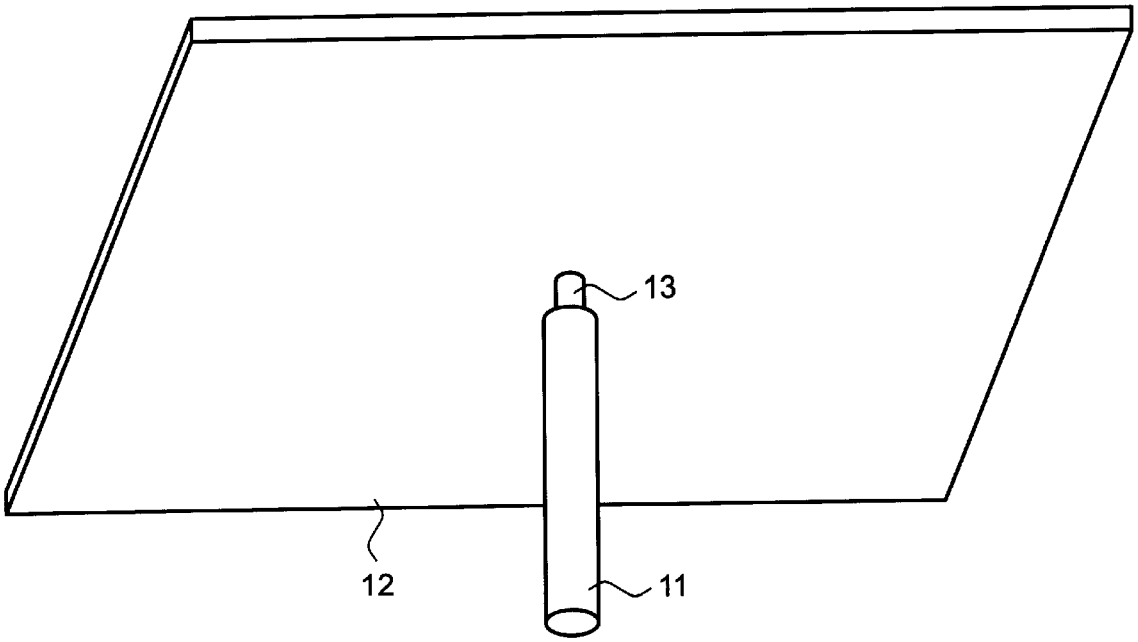
Fig. 1A PRIOR ART
FIGS. 1A and 1B show a prior art antenna, FIG. 1A being a perspective view, FIG. 1B being a side view.
Figure 1B:
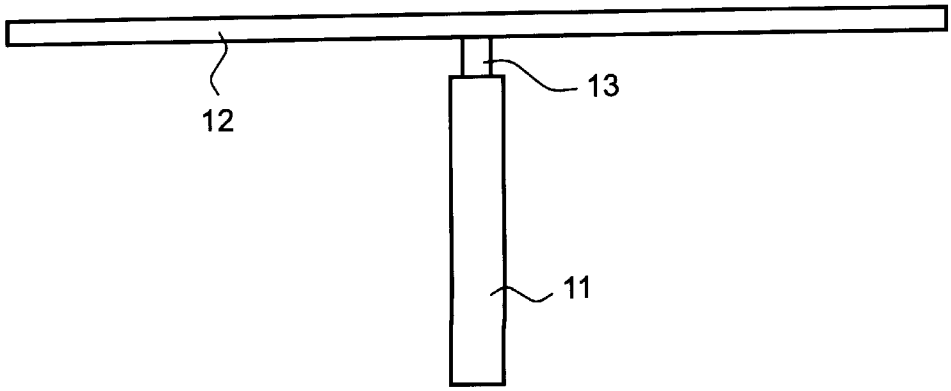
Fig. 1B PRIOR ART
Figure 2A:
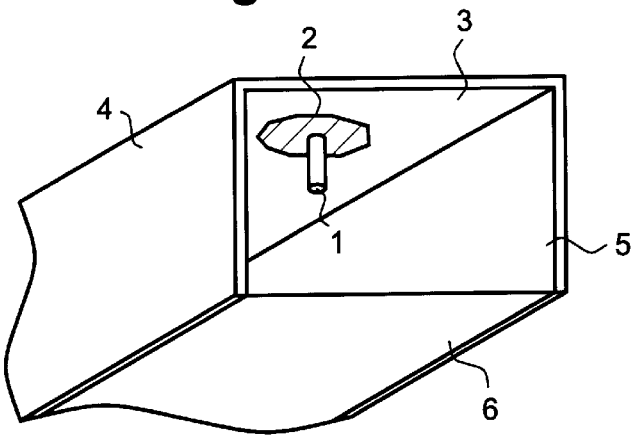
FIGS. 2A to 2C show an example of an antenna of the present invention, FIG. 2B being a perspective view showing the antenna in an installed state, FIG. 2B being a side view showing the antenna, FIG. 2C being a perspective view, to an enlarged scale, showing the sole antenna.
Figure 2B:
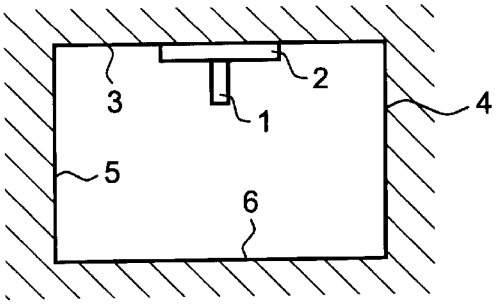
Figure 2C:
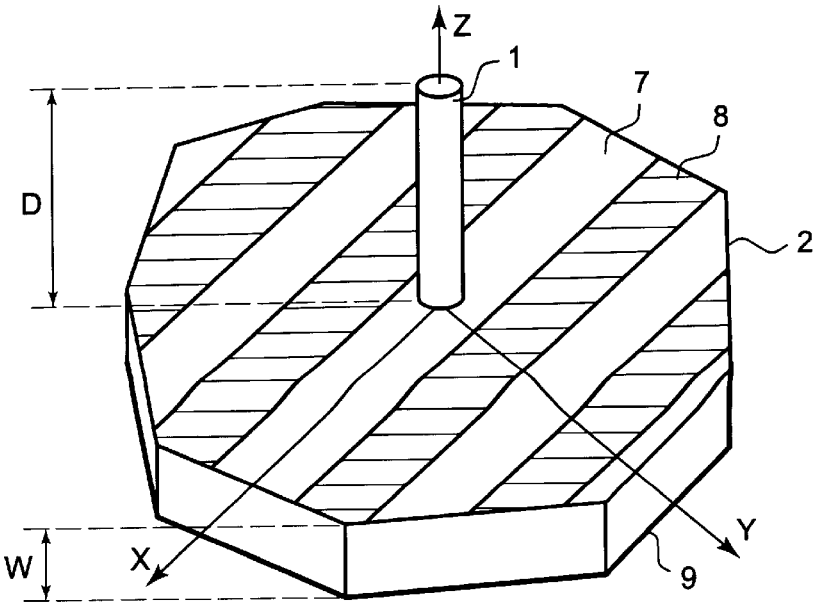

Embodiments of the invention will now be described with reference to the accompanying drawings. FIG. 2A is a view showing an embodiment of the antenna in an installed state, FIG. 2B is a side view showing the same antenna, and FIG. 2C is a perspective view, to an enlarged scale, showing the sole antenna.

Referring to these Figures, the embodiment of the antenna comprises a radiator element 1, which is provided within a reflecting surface of a metal strip reflector (hereinafter referred to as reflector) 2 which is provided with a dielectric layer and a grounded plate of any shape. The radiator element 1 is bar-like or cylindrical in form, or it is at least partly coil-like. The reflector 2 includes a grounded plate 9 and a dielectric layer 7 provided thereon. On the dielectric layer 7 are formed metal strip lines (metal strips) 8, which are in the form of a pattern extending along a road, a passage, etc. defined by a space 4 (i.,e., defined by a ceiling surface 3, side wall surfaces faces 5 and a bottom surface 6) constituting a tunnel, a passageway or an underground shopping area.

The reflector 2 is mounted with the grounded plate 9 being positioned upwardly. The radiator element 1 is mounted on the reflector 2 such that it comes underside of the surface of the metal strips 8. The distance between the length direction center of the radiator element 1 and the surface of the metal strips 8 is set to be about 0.1 to 0.6 times the wavelength of the working frequency.

A base station antenna is a linear antenna, in which the radiator element 1 has a length equal to about 0.25 to 0.5 times the wavelength of the working frequency. In this base station antenna, the radiating element 1 is constituted by a mono-pole antenna or a dipole antenna. In this radiator element 1, the distance d between the power supply or feeding point and the surface of the metal strips 8 is set to be about 0 to 0.6 times the wavelength of the working frequency.

In the reflector 2, the metal strips 8 are spaced at a small uniform interval. The dielectric layer 7 has a uniform thickness, and intervenes between the metal strips 8 and the grounded plate 9. The pitch P and the interval L between the metal strips 8 are set to about 0.01 to 0.35 times the wavelength of the working frequency. The dielectric layer 7 has a dielectric constant $\epsilon r$ set to about 1 to 5.5. The thickness W of the dielectric layer 7 is set to be about 0.01 to 0.5 times the wavelength of the working frequency.

As for the area of the reflector 2, various parameters for computing the area are set to be at least about 3.5 times the wavelength of the working frequency. Where the reflector 2 is a rectangle (square, parallelogram or trapezium), its area can be roughly expressed by the product of the bottom perimeter and the height. Where the reflector 2 is an ellipse, its area $\pi$ is expressed by the product of the radii of the minor and major axes. The bottom perimeter, the height and the radii of the minor and major axes are set to be at least about 3.5 times the wavelength of the working frequency.

The reflection coefficient of the reflector 2 can be adequately set by appropriately selecting the structural parameters, i.e., the pitch P of and the interval L between the metal strips 8 and the dielectric constant $\epsilon r$ and the thickness W of the dielectric layer 7. The radiator element 1 is a vertically polarized antenna, which is substantially straight in form.

When the above construction is viewed in X-Z plane of the antenna, the plane containing the electric field vector is parallel with the metal strips 8, and the incident electromagnetic field is not transmitted through but is reflected by the surface of the metal strips 8. The reflection coefficient is thus a constant of +1 as in the case of the grounded plate 9. The far electromagnetic field is intensified because the electromagnetic field directly radiated from the radiator element 1 and the electromagnetic field reflected by the reflector 2 are in phase. This means that the radiated electromagnetic field has a maximum intensity in the direction parallel to the metal strips 8. The constant noted above is a fixed reflection coefficient which is determined by the working frequency and the pitch and the interval between the metal strips 8.

When the above construction is viewed in Y-Z plane of the antenna, the plane containing the electric field vector is perpendicular to the metal strips 8, and the incident electromagnetic field is transmitted through the surface of the metal strips 8 and the dielectric layer 7, and is reflected by the grounded plate 9. The reflection coefficient is again a constant of +1 as in the case of the grounded plate 9. When it is considered that the metal strips 8 constitute a reference reflection surface, the delayed phase of the reflection coefficient is EXP(−jk2W).

The phase of the reflection coefficient thus can be varied from 0 to 180 degrees by adjusting the thickness of the dielectric layer 7. The electromagnetic field radiated directly from the radiator element 1 is weakened or canceled out by the electromagnetic field reflected by the reflector 2. The radiated electromagnetic field thus has a minimum intensity in the direction perpendicular to the metal strips 8.

In the above construction, the radiator element 1 is installed on a planar boundary wall surface between adjacent metal strips 8 such that its axis is perpendicular to the reflecting surface of the reflector 2. Also, the distance between the surface of the metal strips 8 and the antenna center is set to be about 0.1 to 0.6 times the wavelength of the working frequency. The metal strips 8 with the intermediate wall surface therebetween are set such that they extend along the road. With this arrangement, it is possible to obtain a radiation directivity of the antenna, which is elliptical and suited for intended service area such as elongate underground shopping areas or tunnels.

Figure 3A:
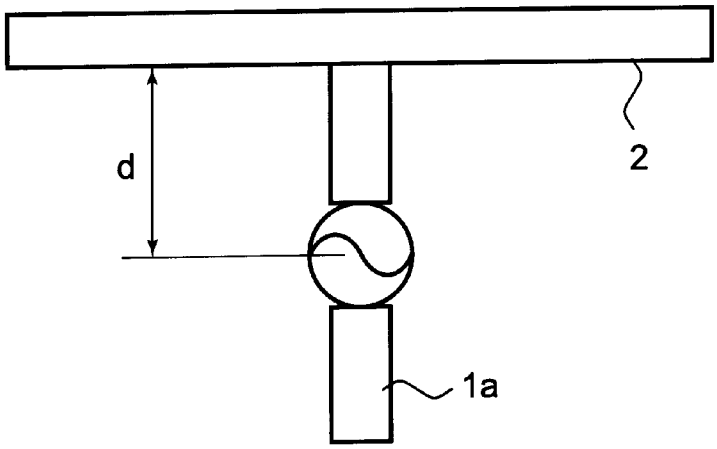
FIGS. 3A to 3C are views showing different examples of radiator element shown in FIGS. 2A to 2C, FIG. 3A showing a dipole antenna, FIG. 3B showing a mono-pole antenna, FIG. 3C showing a partly coil-like mono-pole antenna.
Figure 3B:
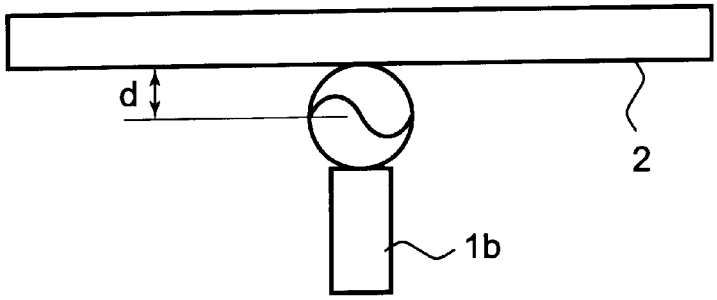
Figure 3C:
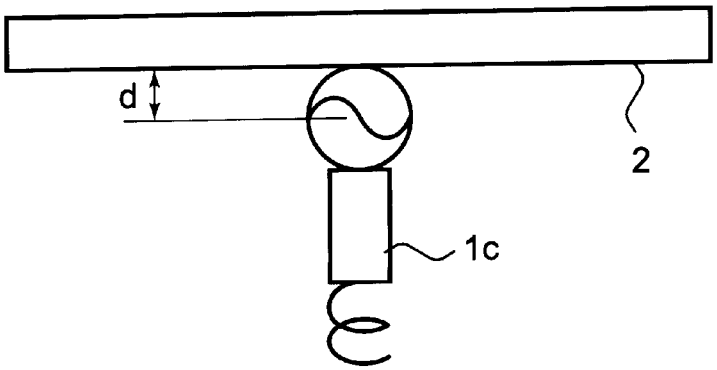

FIG. 3A is a view showing a case in which the radiator element 1 shown in FIGS. 2A to 2C is a dipole antenna. FIG. 3B is a view showing a case in which the radiator element 1 is a mono-pole antenna. FIG. 3C is a view showing a case in which the radiator element 1 is partly constituted by a coil-like mono-pole antenna.

In the case of FIG. 3A, in which the radiator element 1 is constituted by a dipole antenna 1*a*, the distance d between the feeding point and the surface of the metal strips 8 is set to be about 0 to 0.6 times the wavelength of the working frequency.

In the case of FIG. 3B, in which the radiator element 1 is constituted by a mono-pole antenna 1*b*, the distance d between the feeding point and the surface of the metal strips 8 is set to be about 0 to 0.6 times the wavelength of the working frequency.

In the case of FIG. 3C, in which the radiator element 1 is partly constituted by a coil-like mono-pole antenna 1*c*, the distance d between the feeding point and the surface of the metal strips 8 is set to be about 0 to 0.6 times the wavelength of the working frequency.

Figure 4A:
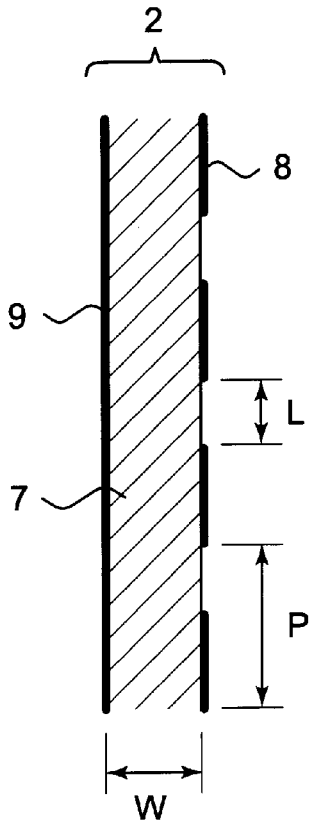
FIGS. 4A and 4B show a reflector shown in FIGS. 2A to 2C, FIG. 4A being a sectional view, FIG. 4B being a perspective view.
Figure 4B:
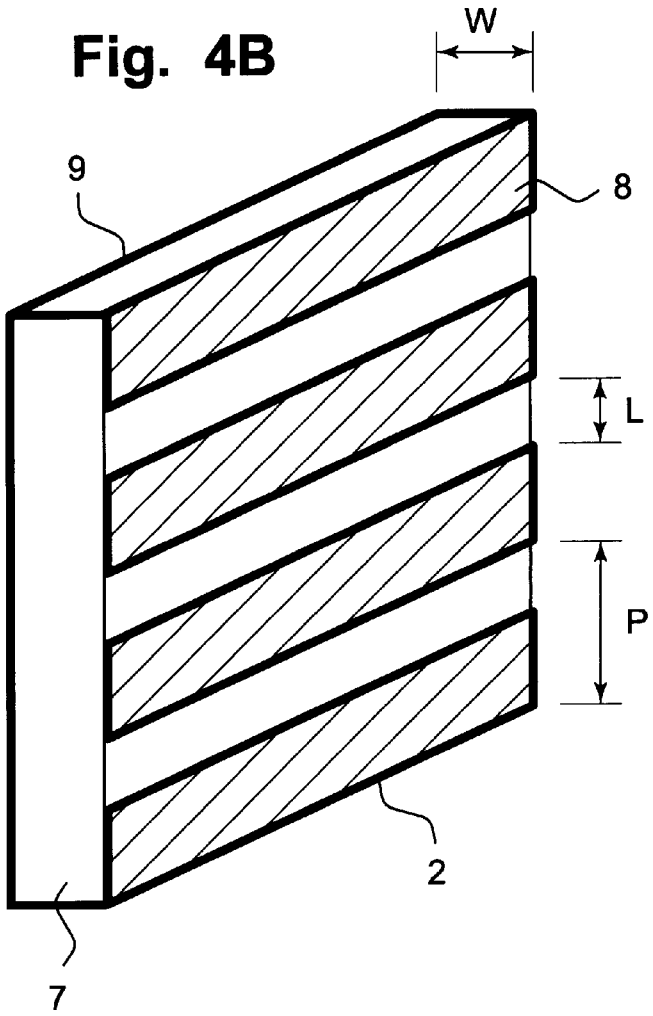

FIGS. 4A and 4B are views showing the structure of the reflector 2 shown in FIGS. 2A to 2C, FIG. 4A being a side view, FIG. 4B being a perspective view. Referring to these Figures, reference numeral 2 designates a reflector, 7 a dielectric layer, 8 metal strips, and 9 a grounded plate. Denoted by P is the pitch of the metal strips 8, L the interval between adjacent metal strips 8, and W the thickness of the dielectric layer 7.

The pitch P of and the interval L between the metal strips 8 are set to be about 0.01 to 0.35 times the wavelength of the working frequency, and the thickness W of the dielectric layer 7 is set to be about 0.01 to 0.5 times the wavelength of the working frequency, and the dielectric constant $\epsilon r$ of the dielectric layer 7 is set to be about 1 to 5.5. As for the area of the rectangular radiator element 2, the bottom perimeter and the height are set to be at least about 3.5 times the wavelength of the working frequency.

Figure 5A:
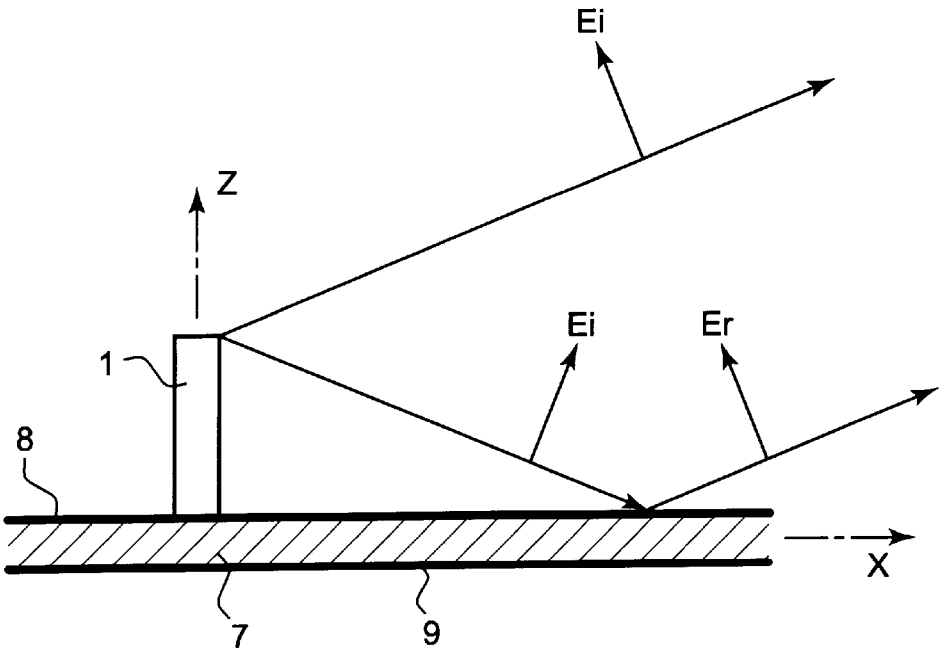
FIGS. 5A and 5B are views showing reflection characteristics of the reflector of the antenna shown in FIGS. 2A to 2C, FIG. 5A showing a characteristic of the antenna in X-Z plane, FIG. 5B showing a characteristic of the antenna in Y-Z plane.
Figure 5B:
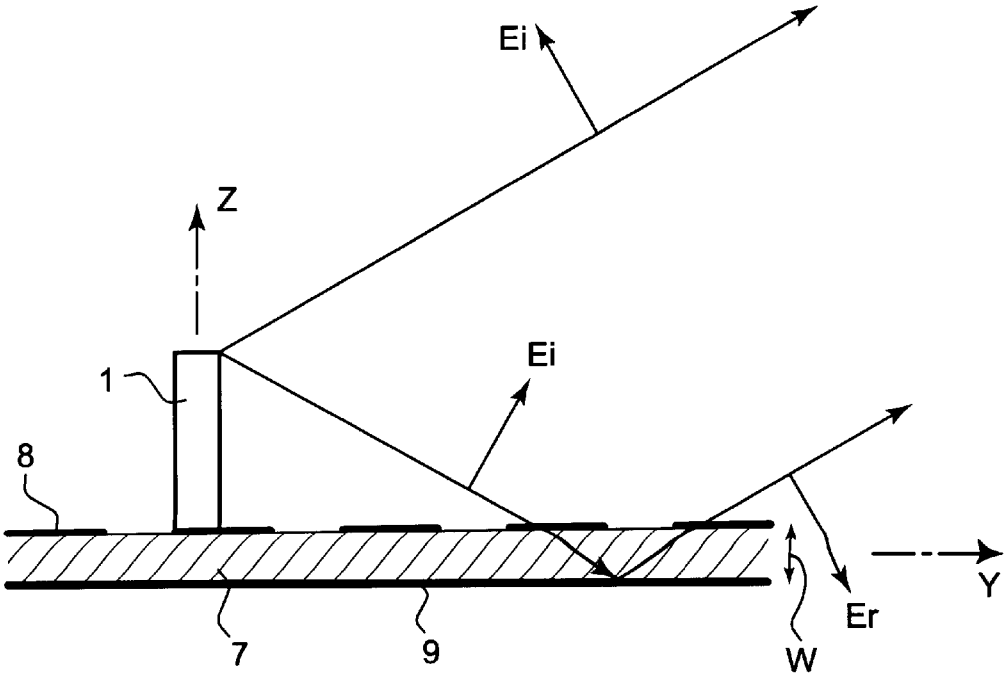

FIG. 5A is a view referred to for describing the reflection characteristics of the reflector 2 in sectional X-Z plane of the antenna shown in FIGS. 2A to 2C. FIG. 5B is a view referred to for describing the reflection characteristics of the reflector in Y-Z sectional plane of the antenna.

In the case of FIG. 5A, the plane containing electric field vectors Ei and Er is parallel to the metal strips 8, the incident electromagnetic field cannot be transmitted through but is reflected by the surface of the metal strips 8. The reflection coefficient is thus a constant of +1 as in the case of the grounded plate 9. The electric field vector Ei is an electric field component of the incident electromagnetic field, and the electric field vector Er is an electric field component of the reflected electromagnetic field.

The far electric field is intensified because the electric field Ei directly radiated from the radiator element 1 and the electric field vector Er reflected by the reflector 2 are in phase. That is, the radiated electromagnetic field has a maximum intensity in the direction parallel to the metal strips 8.

On the other hand, in the case of FIG. 5B, the plane containing the electric field vectors Ei and Er is perpendicular to the metal strips 8, and the incident electric field is transmitted through the surface of the metal strips 8 and the dielectric layer 7, and is reflected by the grounded plate 9. The reflection coefficient is a constant of +1 as in the case of the grounded plate 9. When it is considered that the metal strips 8 constitute a reference reflection surface, the delayed phase of the reflection coefficient is EXP(−jk2W). The phase of the reflection coefficient can be varied from 0 to 180 degrees by adjusting the thickness W of the dielectric layer 7.

The electric field vector of direct radiation from the radiator element 1 is weakened or canceled out by the electric field vector Er of reflection by the reflector 2. The radiated electromagnetic field has a minimum intensity in the direction perpendicular to the metal strips 8.

Figure 6A:
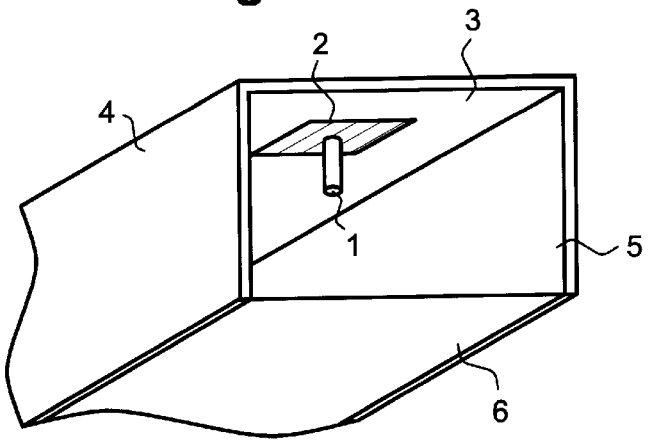
FIGS. 6A to 6C show a different embodiment of the antenna according to the invention, FIG. 6A being a perspective view showing the antenna in an installed state, FIG. 6C being a side view showing the antenna, FIG. 6C being a perspective view, to an enlarged state, showing the sole antenna.
Figure 6B:
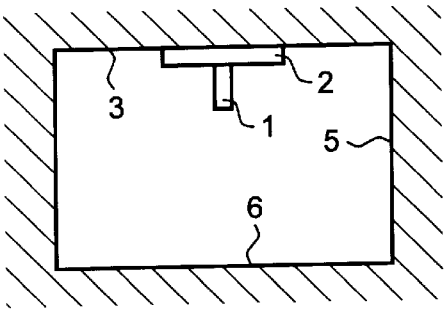
Figure 6C:
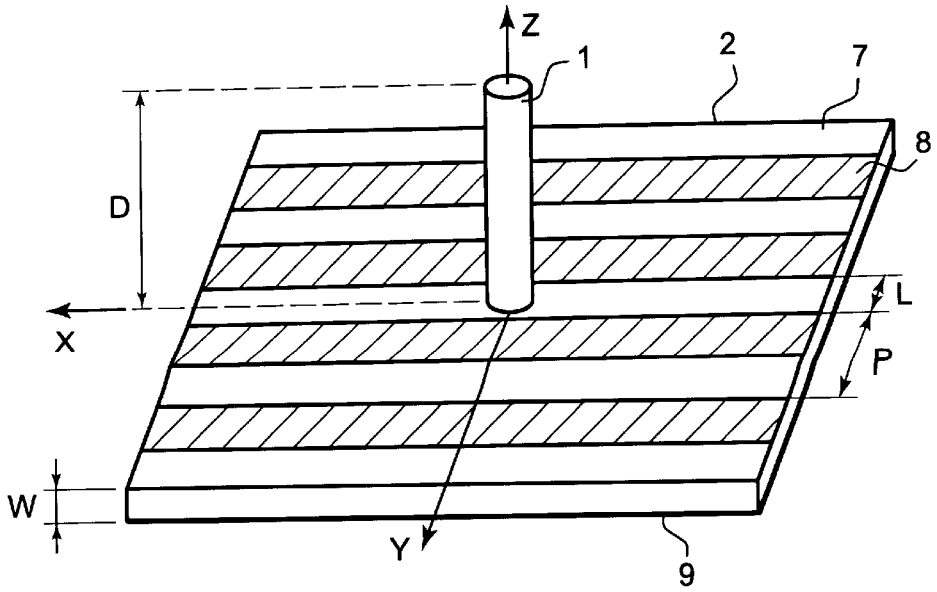

FIGS. 6A, 6B and 6C show a different embodiment of the antenna according to the invention. Specifically, FIG. 6A is a perspective view showing the antenna in an installed state, FIG. 6B is a side view showing the antenna, and FIG. 6C is a perspective view, to an enlarged scale, showing the sole antenna. Referring to these Figures, in this embodiment of the antenna, the reflector 2 is rectangular in form. The radiator element 1 is a mono-pole antenna having a length equal to about 0.25 times the wavelength of the working frequency.

In the Figures, reference numeral 1 designates a radiator element, 2 a reflector, 3 a ceiling surface, 4 a space defining a tunnel or a passageway or a shopping area, 5 side walls, 6 a floor surface, 7 a dielectric layer, 8 metal strips, and 9 a grounded plate.

In FIG. 6C, denoted by D is the length of the radiator element 1, P the pitch of the metal strips 8, L the interval between adjacent metal strips 8, and W the thickness of the dielectric layer 7. In this example, the length D of the radiator element is set to be slightly less than one-fourth of the wavelength of the working frequency, the pitch and the interval L between adjacent ones of the metal strips are set to be about 0.01 to 0.35 times the wavelength of the corresponding working frequency, the thickness W of the dielectric layer 7 is set to about 0.01 to 0.5 times the wavelength, and the dielectric constant $\epsilon r$ of the dielectric sheet 7 is set to be about 1 to 5.5. As for the area of the reflector 2, various parameters for computing the area are set to be at least about 3.5 times the wavelength of the working frequency.

Figure 7A:
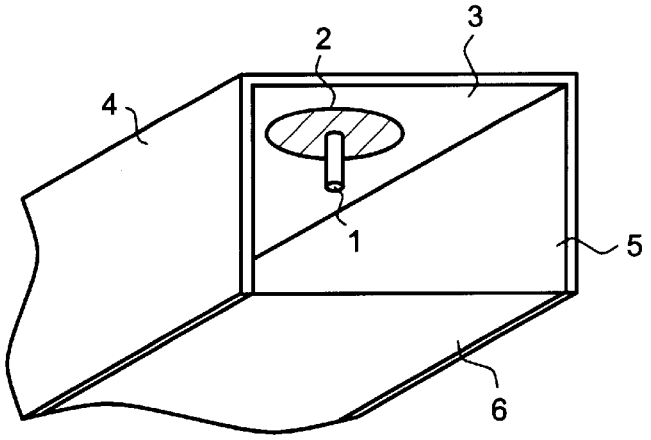
FIGS. 7A to 7C show a further embodiment of the antenna according to the invention, FIG. 7A being a perspective view showing the antenna in an installed state, FIG. 7B being a side view showing the antenna, FIG. 7C being a perspective view, to an enlarged state, showing the sole antenna.
Figure 7B:
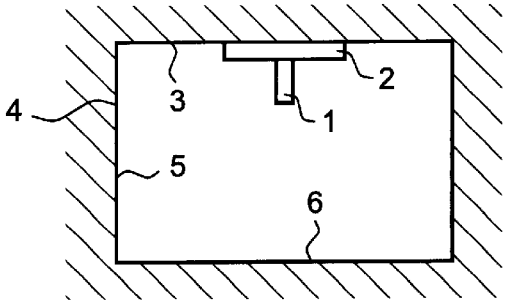
Figure 7C:
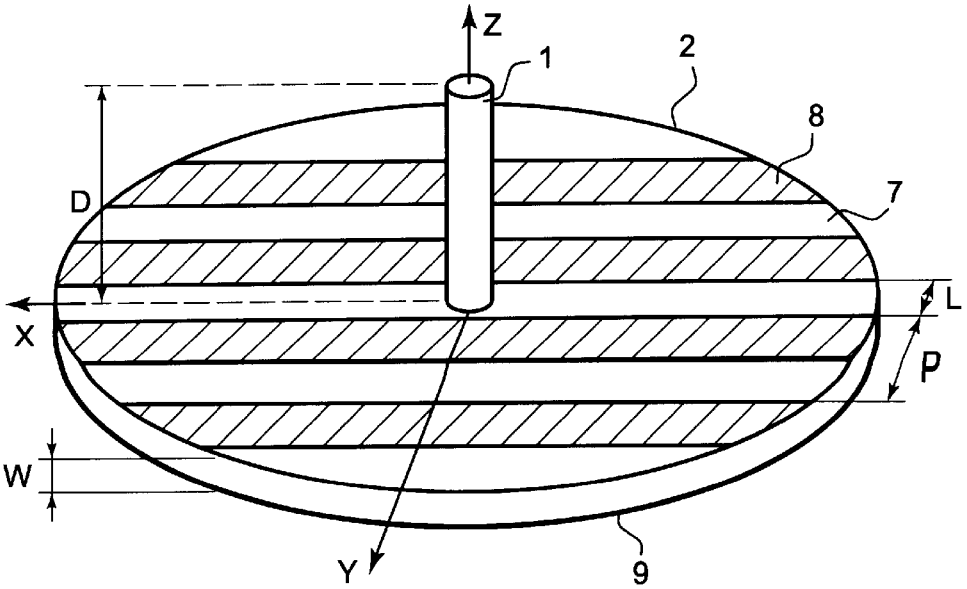

FIGS. 7A to 7C show a further embodiment of the antenna according to the invention. Specifically, FIG. 7A is a perspective view showing the antenna in an installed state, FIG. 7B is a side view showing the antenna, and FIG. 7C is a perspective view, to an enlarged scale, showing the sole 1 antenna. Referring to these Figures, in this embodiment of the antenna the reflector 2 is circular in form, and the radiator element 1 is a mono-pole antenna having a length equal to about 0.25 times the wavelength of the working frequency.

In these Figures, reference numeral 1 designates a radiator element, 2 a reflector, 3 a ceiling surface, 4 a space defining a tunnel or a passageway or an underground shopping area, 5 side wall surfaces, 6 a floor surface, 7 a dielectric layer, 8 metal strips, and 9 a grounded plate.

In FIG. 7C, denoted by D is the length of the radiator element 1, P the pitch of the metal strips 8, L the interval between adjacent metal strips 8, and W the thickness of the dielectric layer 7. In this example, the length of the radiator element is set to be slightly less than one-fourth of the wavelength of the working frequency, the pitch P of and the interval between adjacent ones of the metal strips are set to be about 0.01 to 0.35 times the wavelength, the thickness W of the dielectric layer 7 is set to about 0.01 to 0.5 times the wavelength, and the dielectric constant $\epsilon r$ of the dielectric layer 7 is set to about 1 to 5.5. As for the area of the reflector 2, the radius of the reflector 2 for computing the area thereof is set to be at least about twice the wavelength of the working frequency.

Figure 8A:
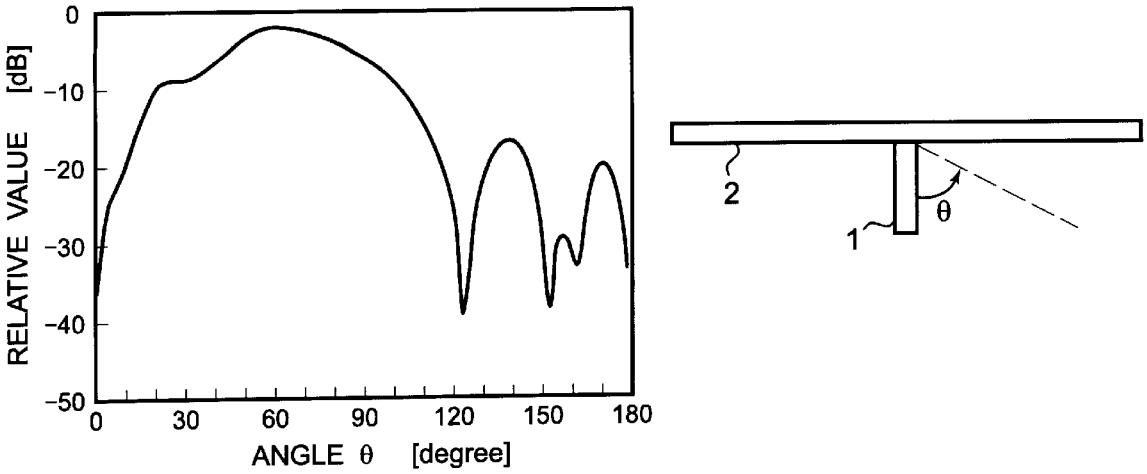
FIGS. 8A to 8C are views showing different directivity patterns, FIG. 8A showing a vertical plane directivity pattern of a further embodiment of the antenna according to the invention along (i.e., in X direction of) the road, FIG. 8B showing a vertical plane directivity pattern of the same antenna along (i.e., in Y direction of) the road, FIG. 8C showing a circular directivity pattern in horizontal plane when antenna is installed in free space and a directivity pattern showing a yet further embodiment of the antenna according to the invention.
Figure 8B:
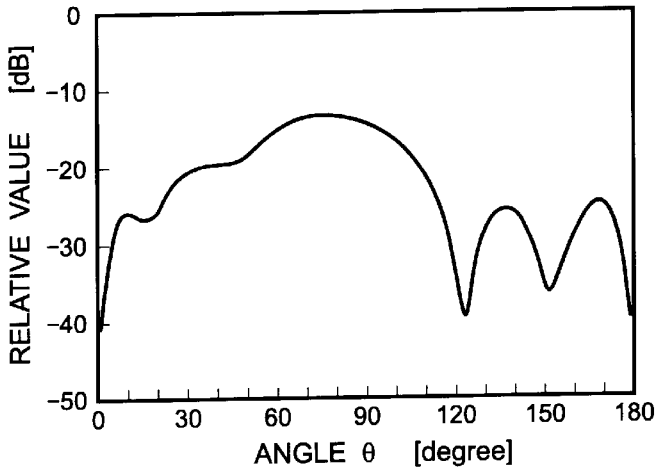
Figure 8C:
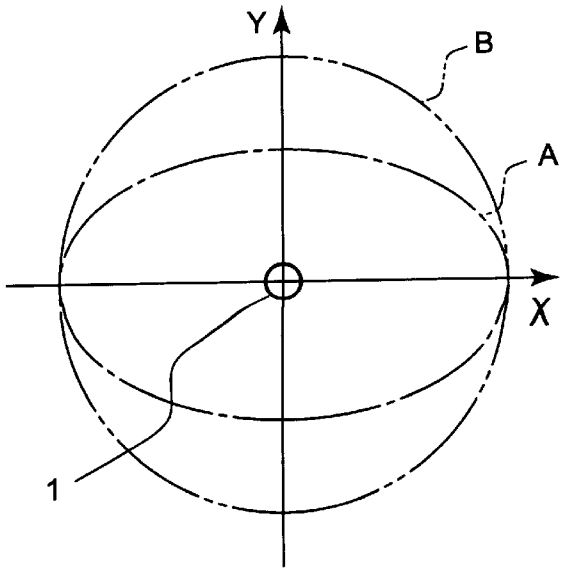

FIGS. 8A to 8C are views showing directivities of other embodiment. FIG. 8A shows a vertical plane directivity pattern in longitudinal direction (X direction) of a road. FIG. 8B shows a vertical plane directivity pattern in transversal direction (Y-direction) of the road. FIG. 8C shows a circular and an elliptical directivity pattern when the antenna according to the invention is installed in a horizontal plane in free space. In these cases, the reflector 2 is circular in shape.

In the graphs shown in FIGS. 8A and 8B, the ordinate is taken for the relative directivity level, and the abscissa is taken for the radiation angle. In the graph shown in FIG. 8C, X direction represents the longitudinal direction of the road, and Y direction is taken for the transversal direction of the road. Labeled A is a a horizontal radiation pattern of the yet further embodiment of the antenna, and labeled B is a horizontal radiation pattern in the case where the antenna is installed in free space.

Figure 9:
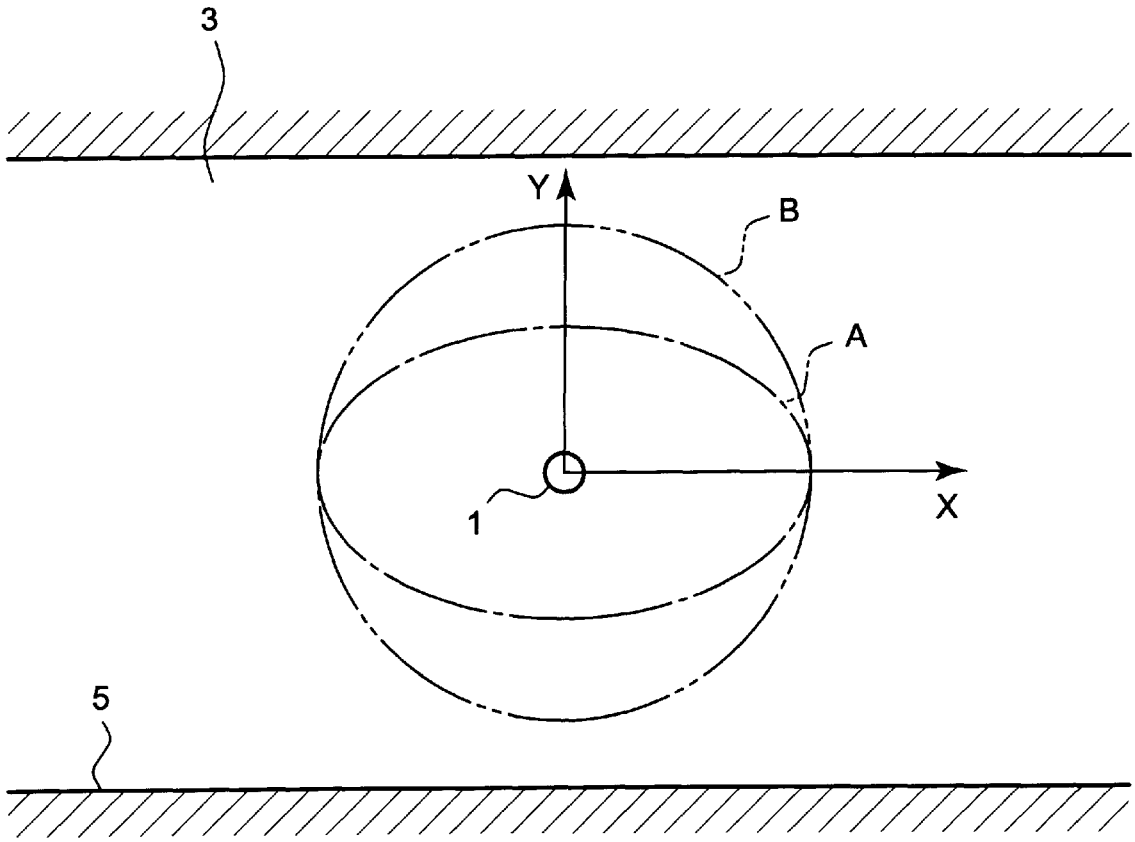
FIG. 9 is a view showing the installation position and radiation patterns of a further embodiment of the antenna according to the invention in a service zone.

FIG. 9 is a view showing the installation position and radiation patterns of a further embodiment of the antenna according to the invention in an elongate service zone such as an underground shopping area and a tunnel. Labeled A and B are radiation patterns.

As shown and described above, the antenna which is installed on the ceiling surface 3 or either side wall surface 5 of the space 4 defined by the ceiling surface 3, side wall surfaces 5 and floor surface 6, comprises a reflector 2, which includes the grounded plate 9, the dielectric layer 7 formed on the grounded plate 9 and the metal strips 8 formed on the dielectric layer 7, and the radiator element 2 disposed to be perpendicular to the reflector 2. The reflector 2 has a reflection characteristic such as to intensify the wave, which is radiated simple non-directive antenna provided on reflection boundary wall along, i.e., in the longitudinal direction of, the road, and to weaken the wave radiated in the transversal direction of the road.

Thus, the antenna according to the invention, when used for radio or television broadcast or mobile communication systems such as pocket bells, portable telephones and car telephones, can cover elongate service zones such as tunnels and underground shopping areas without use of any high cost directive antenna.

The above embodiments were described in connection with cases where a mono-pole antenna is installed on the ceiling surface of an elongate tunnel, passageway or underground shopping area, but other antennas are applicable entirely in the same way so long as they have substantially the same radiation directivity in a vertical plane. For example, an antenna, in which the radiation in horizontal plane is not non-directive, is applicable in the same way.

While the invention has been described in its preferred embodiments, it is to be understood that the words which have been used are words of description rather than limitation and that changes within the purview of the appended claims may be made without departing from the true scope of the invention as defined by the claims.

What is claimed is:

1. An antenna system installed on a ceiling surface or on one of side wall surfaces of a space defined by the ceiling surface, the side wall surfaces and a floor surface, said antenna system comprising:

a reflector including a grounded plate, a dielectric layer formed on said grounded plate, and metal strips having patterns parallel to the longitudinal direction of said space and formed on said dielectric layer; and a radiator element disposed to be perpendicular to a reflecting surface of said reflector.

2. The antenna system according to claim 1, wherein said radiator element is one of a bar form, a cylindrical form, and at least partly a coil form.

3. The antenna system according to claim 1, wherein said reflector has a reflecting surface at which said metal strips and said dielectric layer are disposed alternately.

4. The antenna system according to claim 1, wherein said radiator element has between its center and said reflector a distance set to be about 0.1 to 0.6 times the wavelength of a used frequency.

5. The antenna system according to claim 1, wherein said radiator element is a linear antenna having a length set to be about 0.25 to 0.5 times the wavelength of a used frequency.

6. The antenna system according to claim 1, wherein said radiator element is one of a mono-pole antenna and a dipole antenna with a feeding point thereof being spaced apart from said reflector by a distance equal to about 0 to 0.06 times the wavelength of a used frequency.

7. The antenna system according to claim 1, wherein said reflector has said dielectric layer disposed between said metal strips and said grounded plate and formed in a uniform thickness, said strips having between adjacent ones thereof a pitch and an interval being set to be about 0.01 to 0.35 times the wavelength of a used frequency, said dielectric constant of said dielectric layer being set to be about 1 to 5.5 from the thickness of said dielectric layer and the pitch and the interval between adjacent ones of said metal strips, the thickness of said dielectric layer being set to be about 0.1 to 0.5 times said wavelength.

8. The antenna system according to claim 1, wherein said reflector has its area computed by various parameters that are set to at least about 3.5 times the wavelength of a used frequency.

* * * * *